United States Patent [19]

Ritsko et al.

[11] Patent Number: 4,684,400

[45] Date of Patent: Aug. 4, 1987

[54] METHOD FOR CONTROLLING THE OXYGEN CONTENT IN AGGLOMERATED MOLYBDENUM POWDERS

[75] Inventors: Joseph E. Ritsko, Towanda; David J. Port, Sayre; David L. Houck, Towanda, all of Pa.

[73] Assignee: GTE Products Corporation, Stamford, Conn.

[21] Appl. No.: 831,200

[22] Filed: Feb. 20, 1986

[51] Int. Cl.[4] ..... C22C 1/04

[52] U.S. Cl. ..... 75/0.5 AB; 75/0.5 AC; 75/0.5 BB; 75/0.5 BC

[58] Field of Search ..... 75/0.5 BB, 0.5 BC, 0.5 AB, 75/0.5 AC

[56] References Cited

U.S. PATENT DOCUMENTS 3,973,948 8/1976 Lafferty et al. ..... 75/0.5 AB
4,146,388 3/1979 Lafferty et al. ..... 75/0.5 AC

FOREIGN PATENT DOCUMENTS 1071348 12/1959 Fed. Rep. of Germany ... 75/0.5 BB
823407 11/1959 United Kingdom ..... 75/0.5 BB

*Primary Examiner*—John P. Sheehan
*Attorney, Agent, or Firm*—Donald R. Castle; L. Rita Quatrini

[57] ABSTRACT

A method is disclosed for introducing a controlled level of oxygen into agglomerated molybdenum metal powder, involving heating the powder at a sufficient temperature for a sufficient time in the presence of water vapor, and a non-oxidizing atmosphere with the amount of non-oxidizing atmosphere being controlled to produce a partially oxidized molybdenum powder.

3 Claims, 1 Drawing Figure

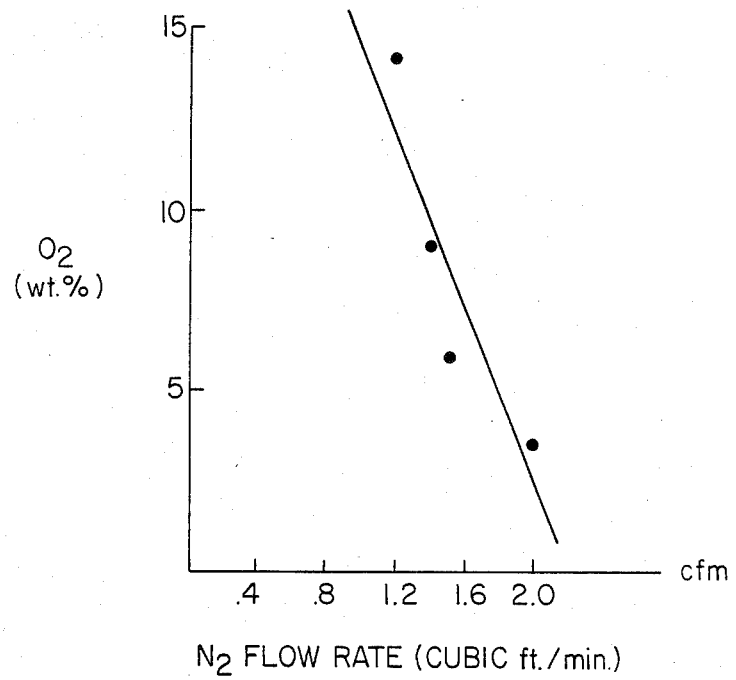
15
10
5
$O_2$
(wt.%)
.4
.8
1.2
1.6
2.0
cfm
$N_2$ FLOW RATE (CUBIC ft./min.)

METHOD FOR CONTROLLING THE OXYGEN CONTENT IN AGGLOMERATED MOLYBDENUM POWDERS

BACKGROUND OF THE INVENTION

This invention relates to a method for controlling the oxygen content of agglomerated molybdenum powders by controlled oxidation of the powders. More particularly it relates to a method of introducing a controlled amount of oxygen into agglomerated molybdenum powders by heating the powders in the presence of water vapor and a controlled relative amount of a non-oxidizing atmosphere.

Flame spraying and plasma spraying are common techniques for the application of protective and wear resistant coatings of various metals, ceramics, and cermets, usually to metal surfaces (substrates). The piston ring industry commonly uses molybdenum coatings on rings for internal combustion engines.

In the flame spraying technique an electric arc or an oxyacetylene flame melts the end of a continuous coil of molybdenum wire and a gas propels it onto a substrate for example, the wear surface of a cast iron piston ring where it splats and solidifies, forming the coating in successive layers. Because of the presence of excess oxygen either from the flame of the surrounding air, or both, the coatings produced by this technique contain large quantities of oxygen, typically from about 7% to about 8% in solution and as various molybdenum oxides. The large quantities of oxygen in the molybdenum apparently harden the coating.

In the plasma spraying of molybdenum, there is usually a minimum of oxygen in the sprayed coating due to the use of an oxygen-lean plasma gas system. That is, argon, helium, hydrogen, nitrogen, or combinations of these gases, all of which are relatively free from oxygen, are used in the plasma spraying process. Hence, any oxygen in the sprayed coating is incidentally due to oxidation of the molten particles by oxygen impurity in the plasma gas and/or surface oxidation of the freshly deposited coating. In such "pure" molybdenum coatings the oxygen level is in the 1% to 2% range. Such coatings are softer than their flame sprayed counterparts.

For higher hardness, therefore, a more expensive process such as the flame spray process which requires wire, or a more expensive powder such as molybdenum plus nickel-base alloy must be used.

It would be desirable therefore to have a method of producing molybdenum powders of sufficiently high oxygen content to enable them to be used in a plasma spray process to produce hard coatings.

U.S. Pat. No. 4,146,388 describes and claims molybdenum plasma spray powders and a process for producing the powders of molybdenum and oxides of molybdenum having an oxygen content of from about 0.5 to about 15% by weight oxygen. The process involves passing molybdenum particles through a plasma with oxygen or oxides of molybdenum to produce the oxygen containing powder.

SUMMARY OF THE INVENTION

In accordance with one aspect of this invention, there is provided a method for introducing a controled level of oxygen into agglomerated molybdenum metal powder, involving heating the powder at a sufficient temperature for a sufficient time in the presence of water vapor, and a non-oxidizing atmosphere with the amount of the non-oxidizing atmosphere being controlled to produce a partially oxidized molybdenum powder.

BRIEF DESCRIPTION OF THE DRAWING

FIG. 1 is a plot of nitrogen flow rate versus weight percent oxygen in the oxidized molybdenum powder.

DETAILED DESCRIPTION ON THE INVENTION

For a better understanding of the present invention, together with other and further objects, advantages and capabilities thereof, reference is made to the following disclosure and appended claims in connection with the above described drawing and description of some of the aspects of the invention.

In the particular applications in which the controlled oxygen molybdenum powders resulting from the method of this invention are preferably used, that is, in plasma spray applications, the desired oxygen content is from about 1% to about 15% and preferably from about 7% to about 10% by weight. At levels lower than this, the hardness of the plasma coating is not improved. At levels higher than this range, coating integrity or bond strength is compromised.

In the practice of this invention, the molybdenum powder has been previously agglomerated and sintered by well known methods.

One preferred method of agglomerating the molybdenum powder is described in U.S. Pat. No. 3,973,948. Methods for agglomerating the powder are disclosed also in a paper entitled "Properties of Oxygen Bearing Molybdenum Coatings," published in the proceedings of the Ninth International Thermal Spray Conference, Denhaag, Netherlands, May 19–23, 1980.

The preferred molybdenum powder of this invention is supplied by the Chemical and Metallurgical Division of GTE Products Corporation under the designation SA-101.

By the method of this invention, the oxygen content of conventional molybdenum powders which preferably consist essentially of less than about 0.05% by weight oxygen can be increased by heating the agglomerated and sintered powder at a sufficient temperature for a sufficient time in the presence of water vapor and a non-oxidizing atmosphere with the amount of the non-oxidizing atmosphere being controlled to produce a partially oxidized molybdenum powder.

The heating can be done by any standard method for heating metal powders.

Preferred methods, involve the use of a rotary calciner or a fluidized bed.

Heating temperatures are generally from about 700° C. to about 900° C. from about 750° C. to about 850° being preferred.

The heating time depends on the temperature and on the type of equipment used. For example, the slope of the calciner tube can be adjusted to vary the length of time that the powder remains in the calciner.

Water is introduced into the furnace to provide the necessary moisture for the process.

The preferred non-oxidizing atmosphere is nitrogen. By controlling the amount of non-oxidizing atmosphere in the ambient atmosphere of the furnace, the degree of oxidation or the oxygen content of the molybdenum powder is controlled. The amount of the non-oxidizing gas can be controlled by controlling the flow rates. It has been found, for example, that when the flow rate of the non-oxidizing atmosphere, for example, nitrogen, is decreased, the oxygen content of the resulting partially oxidized molybdenum is increased. This will be apparent in the example that follows.

The resulting partially oxidized molybdenum powder is made up of essentially spherical particles. The oxygen content of this powder ranges from about 3% to about 15% by weight.

X-ray analyses of the partially oxidized powder generally shows molybdenum, molybdenum dioxide, and sometimes molybdenum trioxide. Undesirable molybdenum trioxide can be eliminated by using ammonia solution to dissolve it without disturbing other desirable properties of the powder.

Also, in the event that the oxygen content is too high, the powder can be subjected to standard reduction methods to reduce the oxygen content.

To more fully illustrate this invention, the following nonlimiting example is presented.

EXAMPLE

Molybdenum powder type SA-101 from GTE which has been spray dried and which is −200, +325 mesh is fed at the rate of about 12 pounds per hour into a 6″ diameter rotating calciner at a temperature of about 800° C. under a nitrogen atmosphere. Water is fed by a separatory funnel at the rate of about 20 to about 30 cc/min to provide the necessary moisture for the oxidation process. The resulting powder is in the force of essentially spherical brown particles with a bulk density of from about 2.4 to about 2.8 g/cc.

The above procedure is carried out with the flow rate of the nitrogen being varied.

The oxygen contents of the resulting powders are given below along with the flow rate of the nitrogen.

| $N_2$ CFM | Weight percent $O_2$ |
|---|---|
| 2.0 | 3.21 |
| 1.5 | 5.84 |
| 1.4 | 8.61 |
| 1.2 | 14.29 |

A plot of the nitrogen flow rate versus weight percent oxygen in the resulting powder is shown in FIG. 1.

It can be seen that a direct correlation exists between the flow rate of the nitrogen and the percent oxygen in the oxidized powder. As the nitrogen flow rate decreases, the degree of oxidation as shown by the weight percent oxygen increases.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for introducing a controlled level of oxygen into agglomerated molybdenum metal powder, said method comprising heating said molybdenum powder at temperature of from about 700° C. to about 900° C. for a sufficient time in the presence of water vapor and a non-oxidizing atmosphere, with the amount of said non-oxidizing atmosphere being controlled to produce a partially oxidized molybdenum powder.

2. A method of claim 2 wherein said non-oxidizing atmosphere is nitrogen.

3. A method of claim 3 wherein the oxygen content of said partially oxidized molybdenum powder is from about 3% to about 15% by weight.

* * * * *